US005303013A

United States Patent [19]

Koike et al.

[11] Patent Number: 5,303,013

[45] Date of Patent: Apr. 12, 1994

[54] COLOR PICTURE IMAGE FORMATION DEVICE FOR DEVELOPING LATENT IMAGE FORMED ON A PHOTOSENSITIVE BODY

[75] Inventors: Shuji Koike; Akihiko Ishii; Shino Sakai, all of Kawasaki, Japan

[73] Assignee: Fujitsu Limited, Kawasaki, Japan

[21] Appl. No.: 851,613

[22] Filed: Mar. 16, 1992

[30] Foreign Application Priority Data

Mar. 18, 1991 [JP] Japan ..... 3-051876
Jul. 19, 1991 [JP] Japan ..... 3-179423

[51] Int. Cl.[5] ..... G03G 15/01; G03G 15/14

[52] U.S. Cl. ..... 355/271; 355/327

[58] Field of Search ..... 355/271, 272, 273, 274, 355/275, 279, 326, 327

[56] References Cited

U.S. PATENT DOCUMENTS

| | | | |
|---|---|---|---|
| 3,533,692 | 10/1970 | Blanchette et al. | 355/274 X |
| 3,827,800 | 8/1974 | Tanaka et al. | 355/271 X |
| 3,955,530 | 5/1976 | Knechtel | 355/279 X |
| 3,976,370 | 8/1976 | Goel et al. | 355/271 X |
| 4,588,279 | 5/1986 | Fukuchi et al. | 355/271 |
| 4,935,788 | 6/1990 | Fantuzzo et al. | 355/326 |
| 5,028,964 | 7/1991 | Landa et al. | 355/273 |
| 5,038,178 | 8/1991 | Hosoya et al. | 355/277 |
| 5,040,029 | 8/1991 | Rodenberg et al. | 355/271 |
| 5,065,183 | 11/1991 | Morofuji et al. | 355/272 X |
| 5,084,735 | 1/1992 | Rimai et al. | 355/271 |
| 5,099,286 | 3/1992 | Nishise et al. | 355/272 |

FOREIGN PATENT DOCUMENTS

| | | |
|---|---|---|
| 0373704 | 6/1990 | European Pat. Off. . |
| 0399186 | 11/1990 | European Pat. Off. . |
| 60-049357 | 3/1985 | Japan . |
| 9008984 | 8/1990 | World Int. Prop. O. . |

*Primary Examiner*—Fred L. Braun

[57] ABSTRACT

A color picture image formation device includes a plurality of photosensitive body drums and a plurality of image formation sections each consisting of a charge unit, an exposure unit and a plurality of developing units for developing toner picture images of various colors and an intermediate transfer body for holding the toner powder images of required number of colors, which transfers the toner picture images to the recording paper and fixes them thereon by a fixing unit after all the toner picture images have been formed on the intermediate transfer body. A transfer voltage is applied by the intermediate transfer body for every developing unit. The intermediate transfer body is a drum formed as a multiple layer structure including a metallic tube, an insulation layer, a metallic conductive electrode which is split into a plurality of sections, and a voltage application layer on the surface of the metallic tube. A transfer roller transfers the toner-picture images onto the recording paper. A voltage application brush which comes into contact with the sections of the metallic conductive electrode applies voltage to the intermediate transfer body.

17 Claims, 17 Drawing Sheets

COLOR PICTURE IMAGE FORMATION DEVICE FOR DEVELOPING LATENT IMAGE FORMED ON A PHOTOSENSITIVE BODY

BACKGROUND OF THE INVENTION

1. Field of the Invention

The present invention relates to a color picture image formation device for developing the latent images formed on a photosensitive body drum in sequence by use of the color toners different in colors, transferring each of said developed toner images once onto a picture image retaining medium and transferring them on a recording paper after all the toner picture images have been formed on the picture image retaining medium.

A color printer, a color facsimile, a color copier, etc. can be enumerated as this type of unit.

As known, an electrophotography recording unit covers a picture image formation process and a recording paper transfer process, and the picture image formation process further consists of an electrostatic latent image formation process, an electrostatic latent image development process, a transfer process and a fixing process.

In the electrostatic latent image formation process, the electrostatic latent image is formed by optically projecting a picture image on a photosensitive body drum or a photosensitive body belt or by providing electric charge on a dielectric drum.

In the electrostatic latent image development process, the electrostatic latent image is developed by electrostatically adhering the toner as a recording medium onto the electrostatic latent image which has been formed in that manner. The toner which has been used in the development is transferred to the recording paper in the transfer process, then the transferred toner is fixed onto the recording paper in the fixing process.

In such a color recording device as expressing many colors with use of color toners, this invention relates to a color recording device which has a plurality of photosensitive body drums, forms the color toner picture images on said drums, then transfers these color toner picture images sequentially onto the intermediate transfer body, and after all the color picture images have been formed on said intermediate transfer body, they are transferred at a time onto the recording paper for the formation of picture image thereon.

2. Description of the Prior Art

The system of color recording device covers the system for transferring the toners sequentially to the intermediate transfer body from a single photosensitive body drum and the system for developing the respective color toners on a plurality of photosensitive body drums and for transferring the toners sequentially on the intermediate transfer body. The present invention relates to the color picture image formation device of latter construction. FIG. 1 and FIG. 2 show prior art color picture image formation devices of the foregoing type.

The prior art color picture image formation device shown in FIG. 1 comprises an image formation module for respective colors, which has image formation sections 1 and 2 each constituted of a precharge device 1*c* (not shown in the developing section 2), a write section 1*d* (not shown in the developing section 2), a toner developing section 1*e* (not shown in the developing section 2), a discharge device 1*f* (not shown in the developing section 2) and a cleaner 1*g* (not shown in the developing section 2).

An intermediate transfer body 3 has any of the constructions suitable of being turned or being tensed via a roller (not shown in the figure) for its running, and respective write transfer sections 1*b* and 2*b* consist of transfer devices 1*a* and 2*a* for transferring a toner image to said intermediate transfer body 3 and also the respective photosensitive drum sections opposite to the intermediate transfer section 3. Numeral 4 denotes a paper side unit for transferring and fixing the toner image on the paper 100 from the intermediate transfer body 3.

In this type of structure, the respective image formation modules 1 and 2 compensate the phase only by a phase differential portion determined by a circumferential speed and the difference between the distance from write sections 1*d* (2*d* is not shown in the figure) on respective photosensitive drums for synthetic overlapping to the write transfer sections 1*b* and 2*b* and the distance from the write transfer sections 1*b* and 2*b* on the respective intermediate transfer bodies 3 to the output transfer section 4*a*. A color picture image is formed by writing the data for respective colors to be overlapped on the respective write sections 1*d* (2*d* is not shown in the figure), developing the image with use of the respective color toners, transferring the image onto the intermediate transfer body 3 and synthesizing the image on this intermediate transfer body 3.

The intermediate transfer body 3 of the device shown in FIG. 1, is a body that is structured by laying out on a drum an endless hoop material made of dielectric sheet describe in Japanese Unexamined Patent Publication (Kokai) No. 61-13263. And, as mentioned above, this device has any of the suitable constructions either for turning said intermediate transfer body 3 itself or for tensing it via a roller (not shown in the figure) for its running.

The color picture image recording device shown in FIG. 2 is equipped with process units P1, P2, P3 and P4 having 4 pieces of photosensitive body drums 7*a*, 7*b*, 7*c* and 7*d*, respectively, positioned as their centers and an intermediate transfer body drum 12. The process unit P1 includes a charge device 8*a*, a latent image formation unit 9*a*, a developing device 10*a* and a cleaner 11*a* which are installed around the photosensitive body drum 7*a*. The other process units P2 through P4 have similar constructions, wherein numerals 8*b*, 8*c* and 8*d* denote the charge devices, 9*b*, 9*c* and 9*d* the latent image formation units, 10*b*, 10*c* and 10*d* the developing devices and 11*b*, 11*c* and 11*d* the cleaners. The developing agents of respectively different colors are contained in the developing devices 10*a* through 10*d* of the respective process units. 3 original colors, Y (yellow), M (magenta) and C (cyan), necessary for color recording, are used respectively in the developing devices 10*a*, 10*b* and 10*c*, while the BK (black) is used, for compensating the black, in the developing device 10*d*.

The recording by the device shown in FIG. 2 is carried out as per the following procedures.

Simultaneously with the recording paper being unrolled on the carrier road in recording the image, the latent images corresponding to the signals of various colors are formed sequentially on the respective photosensitive body drums 7*a* through 7*d*. The latent image is formed by charging the surfaces of respective photosensitive body drums 7*a* through 7*d* uniformly by use of the corresponding charge devices 8*a* through 8*d* and by forming the image by the latent image formation devices 9*a* through 9*d*. The latent images are developed by the developing devices 10*a* through 10*d* into the formation of toner images of Y, M, C and BK (black) colors. The toner picture images on these photosensitive body drums 7*a* through 7*d* are transferred and overlapped sequentially onto the intermediate transfer body drum 12 for the formation of a toner picture image. After the toner picture image has been formed on the intermediate transfer body 12, said image is transferred on to the recording paper 100 by the transfer device 12 and then fixed thereon.

The intermediate transfer body 12 of the device shown in FIG. 2, as described in the Japanese Unexamined Patent Publication (Kokai) No. 63-311273 proposes and is a metallic support body drum around which a low resistance rubber is rolled up, wherein, as it is stated in the above disclosure be transferred nicely by impressing a constant voltage to the metallic support body drum which becomes the base material of this intermediate transfer body and by sequentially changing the voltage applied to the respective picture image processes P1, P2, P3 and P4.

Because the drum body shown in FIG. 1 adopts such a construction as either arranging on the drum an endless hoop material made of dielectric sheet for its turning, or tensing it via a roller for its running, the intermediate transfer body drum has a problem in its strength in addition to the deterioration in an output resulting from the generation of thermal shrinkage, deformation, etc. of a dielectric film. Moreover it is difficult to uniformly maintain, over a long period of time, the contact width and contact pressure in the contact section between the intermediate transfer body drum and the photosensitive drum because the dielectric film alone is used.

Further the device shown in FIG. 2 is not practical because the potentials of the pre-charge device, development bias and photosensitive body drum as the locations for readjusting the conditions require a very fine adjustment although the potentials of respective picture image processes in the intermediate transfer bodies are adjusted in each process.

SUMMARY OF THE INVENTION

Therefore, an object of this invention is to maintain the contact width and contact pressure uniformly, over a long period of time, at the contact section between the intermediate transfer body drum and the photosensitive body drum in the case of the intermediate transfer body as shown in FIG. 1 and to simplify the potential adjustment of respective processes and also to overlap the respective color toner picture images necessary for a color picture image accurately onto the intermediate transfer body.

According to the present invention, there is provided a color picture image formation device having a plurality of photosensitive body drums, said device comprising:

a plurality of image formation sections, each comprising one of said photosensitive body drums, an electrocharge unit, an exposure unit, and a developing unit for developing a respective color toner image on said photosensitive body drum; an intermediate transfer body for holding toner powder images in a required number of colors, so that said respective color toner images on said photosensitive body drums are transferred, respectively, onto said intermediate transfer body and, after all of the toner picture images have been formed on said intermediate transfer body, the toner picture images thereon are transferred onto a recording paper and then fixed thereto by a fixing unit; characterized in that a transfer voltage, which should be exerted to the intermediate transfer body can be regulated for a respective area corresponding to the respective developing units and said transfer voltage is grounded at a transfer area to a recording are of the recording paper.

According to another aspect of the present invention there is provided a color picture image formation device comprising a plurality of image formation sections, each comprising a photosensitive means, an electrocharge unit, an exposure unit, and a developing unit for developing a single color toner image on said photosensitive means; an intermediate transfer body for holding toner powder images in a required number of colors, so that said respective color toner images on said photosensitive means are transferred, respectively, onto said intermediate transfer body and, after all of the toner picture images have been formed on said intermediate transfer body, the toner picture images thereon are transferred onto a recording paper and then fixed thereto by a fixing unit; and means for exerting a voltage onto said intermediate transfer body for transferring said respective color toner picture images; if a "transfer wherein, if a transfer efficiency is defined as a ratio of the amount of toner of the toner image formed on said intermediate transfer body to the amount of toner of the toner image formed on said photosensitive means, a transfer efficiency of a first color transfered directly on the intermediate transfer body as a lowermost layer is more than those of the colors other than said first color.

Due to this invention the voltage to be transferred to each of developing units can be applied by the intermediate transfer body and the transfer section can be grounded in the transfer to the recording paper, the primary transfer voltage can apply an optimum transfer voltage in each picture image formation process in the primary transfer with the photosensitive means of each picture image formation section.

DETAILED DESCRIPTION OF THE PREFERRED EMBODIMENTS

Figure 1:
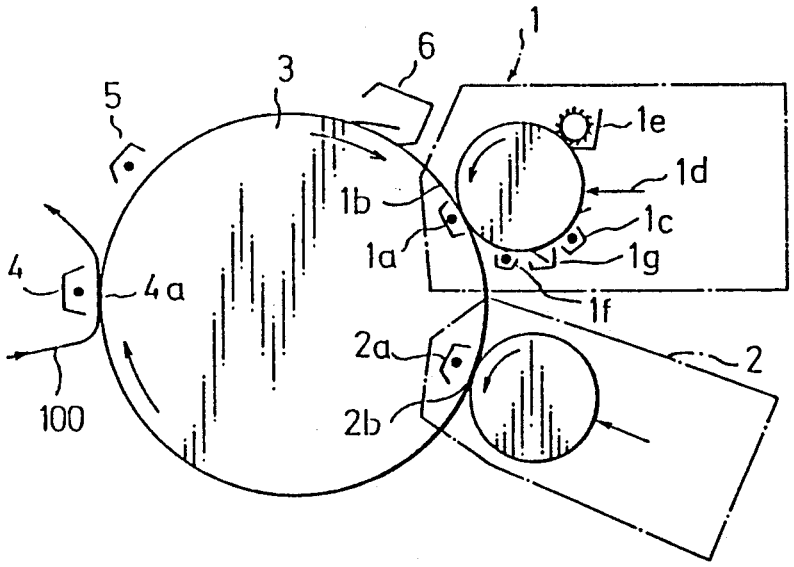
Fig.1 (PRIOR ART)
FIG. 1 is a schematic diagram of a color picture image formation device of the prior art.
Figure 2:
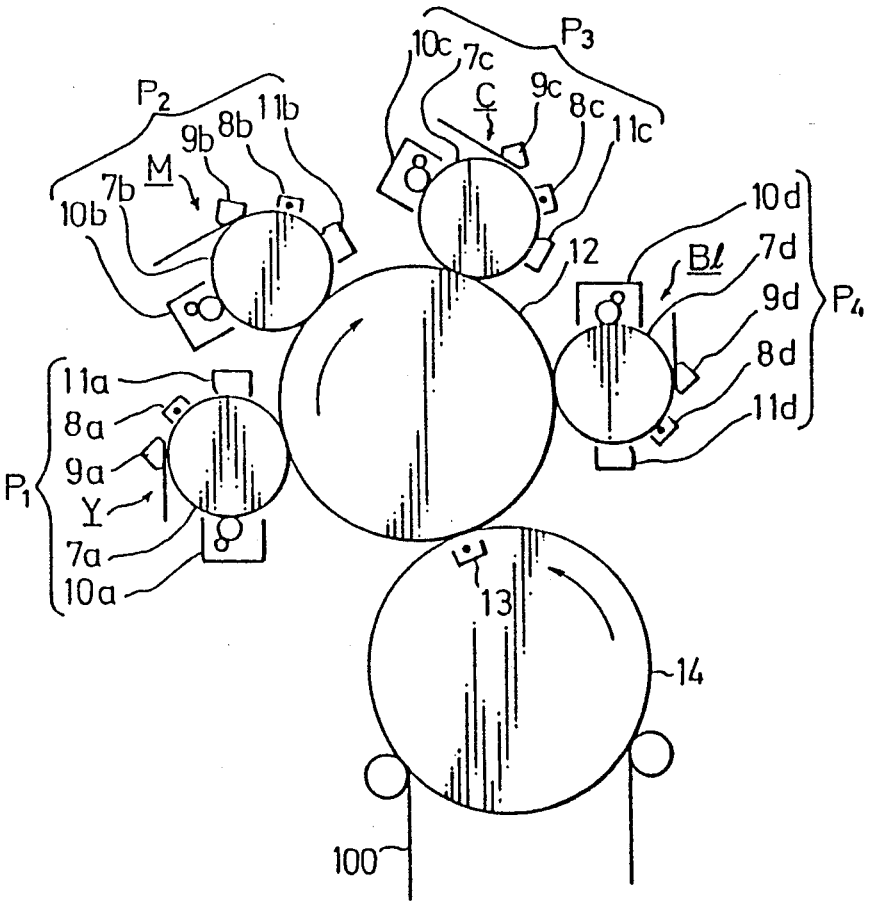
Fig. 2 (PRIOR ART)
FIG. 2 is a schematic diagram of another color picture image formation device of the prior art.
Figure 3:
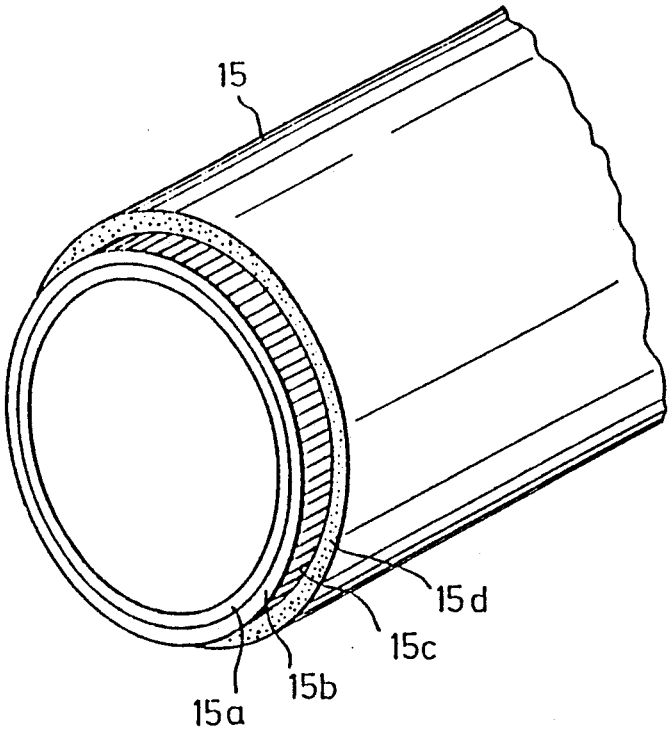
FIG. 3 is a partial perspective view of an intermediate transfer body drum of a first embodiment.

FIG. 3 shows the basic structure of an intermediate transfer body drum 15 of a first embodiment. An insulation layer 15*b* is laid out throughout the drum circumference on an elementary tube 15*a* of rigid conductive metal, for instance, aluminum, then the metallic conductive electrodes 15*c* which are arranged at equal intervals on said surface, and are bonded in the longitudinal direction. Further, a pressurization conductive rubber 15*d* is lined on metallic conductive electrodes 15*c* with one end being left over by a certain width so that no irregularities may exist on the surface of finally structured intermediate transfer body 15.

Figure 4:
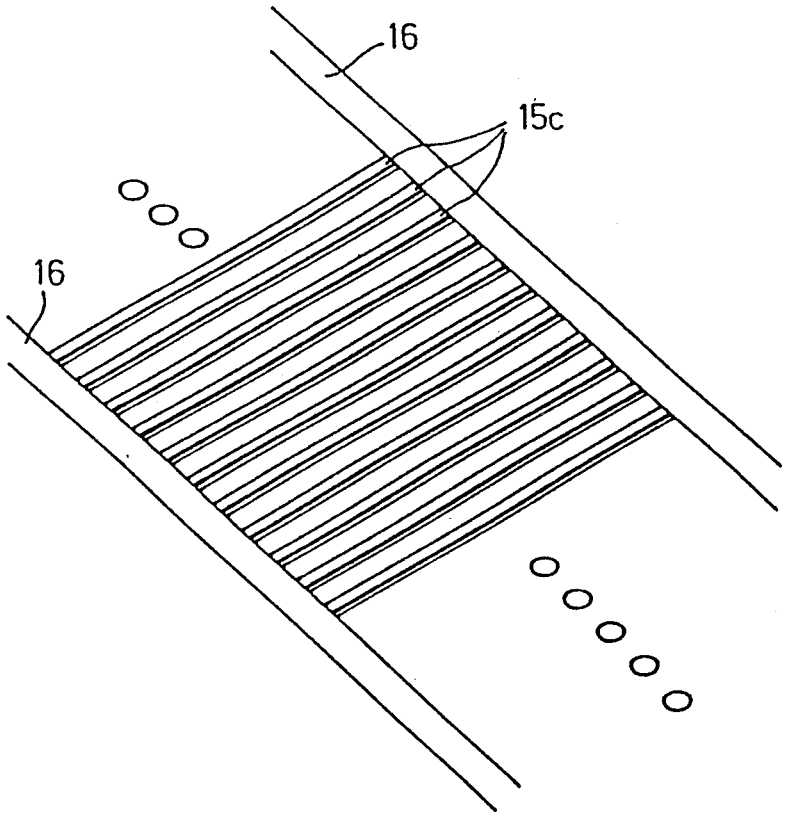
FIG. 4 is a top view of a metallic conductive electrode to be used for the intermediate transfer body drum of the first embodiment.

FIG. 4 shows the structure of metallic conductive electrodes 15*c* which are used in the intermediate transfer body drum 15 of the first embodiment. The metallic conductive electrodes 15*c* are arranged in parallel at equal intervals and ends of the electrodes are fixed with adhesive tapes 16. The metallic conductive electrodes 15*c* should be free from getting bent relative to the axis of elongation the electrodes made of stainless steel are preferable. The length of metallic conductive electrodes 15*c* needs to be equal to or longer than the width of intermediate transfer body drum 15.

Figure 5:
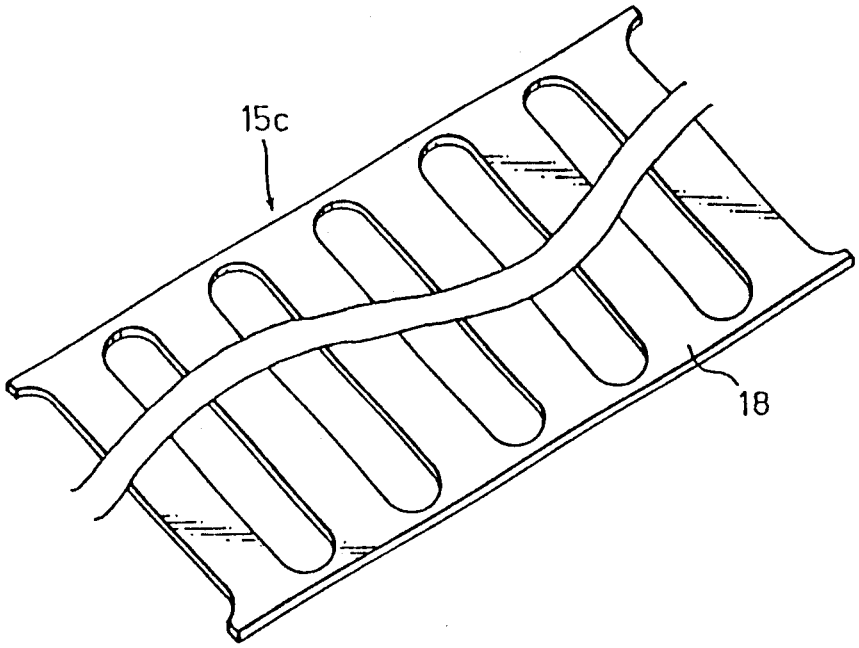
FIG. 5 is a perspective view of another example of a metallic conductive electrode to be used for the intermediate transfer body drum of the first embodiment.

FIG. 5 illustrates another embodiment of metallic conductive electrode 15*c*. Element 18 is a plate or belt of metal or a material having same degree of conductivity as the metal, and should be free from becoming bent relative to the elongation of axis an electrode, similarly to the embodiment shown in FIG. 4. Preferably the electrode is made of stainless steel. This stainless steel plate 18 is punched in the pattern as shown in FIG. 5 so that this punched pattern may have uniform intervals between punched holes in the longitudinal direction of stainless steel plate or belt. In addition, the width of stainless steel belt needs to be longer than the width of intermediate transfer body drum 15, and the length of the punched portion similarly needs to be greater than the width of the intermediate transfer body drum 15. The width which forms the metallic conductive electrode sections in this pattern and the intervals between the metallic conductive electrodes should be identical to the intervals between the metallic conductive electrodes shown in FIG. 4.

Figure 6:
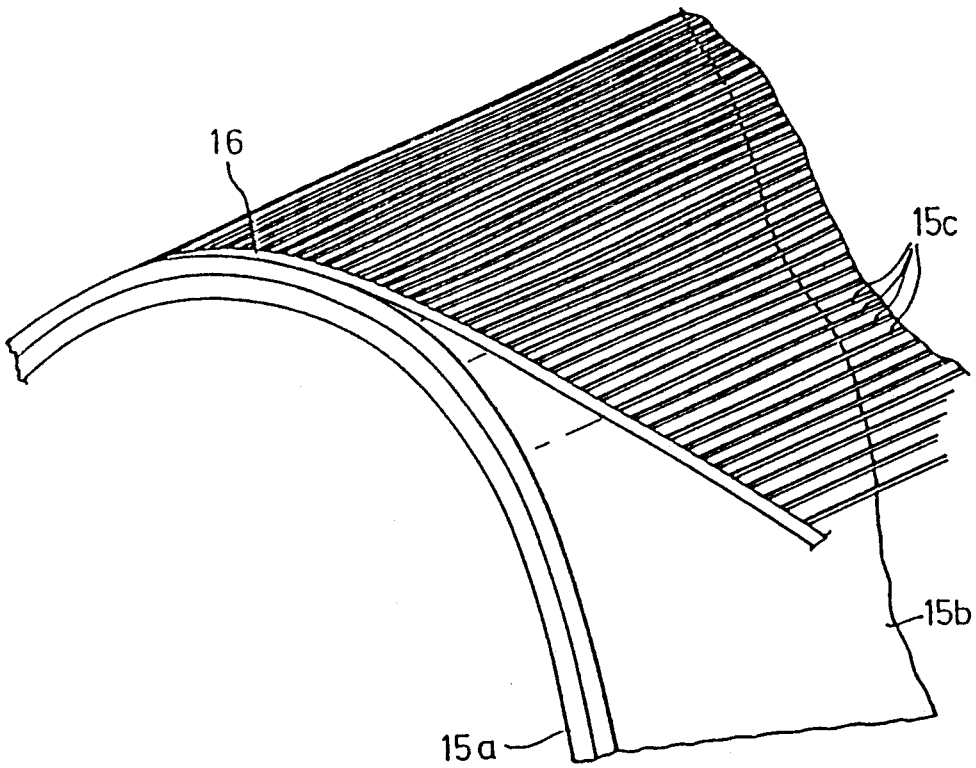
FIG. 6 is a view showing the formation process of the intermediate transfer body drum.

FIG. 6 shows the formation process of the intermediate transfer body drum using the above described type of the metallic conductive electrode 15*c*. First, the insulation layer 15*b* is formed on the surface of aluminum tube 15*a*. In this process, an insulating material may be deposited or spattered for its adhesion on the aluminum elementary tube, or an aluminum surface may be oxidation-treated to make it have the insulation property. In this embodiment, the aluminum surface was alumite-treated for the formation of insulation layer. Next, after obtaining this insulation property, a unit of metallic conductive electrodes 15*c* of the structure as shown in FIG. 4 is made ready for by extending the portion of its length equal to the circumference of the intermediate transfer body drum 15, after the alumite-treatment (or, after a unit of metallic conductive electrodes 15*c* has been wound around the intermediate transfer body drum 15, its longer section should be cut off), then the tape 16 at one end of the electrode shown in FIG. 4 is pasted up in line with one end of intermediate transfer body 15. The bonding method of the metallic conductive electrode 15*c* with the insulation layer 15*b* at this time is not especially limited, but independently on whether the bonding agent used is dielectric or conductive, each of metallic conductive electrodes 15*c* should not have any conductivity via the bonding agent. Also, if the tape covering the metallic conductive electrodes 15*c* should exist on the surface of intermediate transfer body drum 15, utmost attention must be said to such a case because the metallic conductive electrodes 15*c* won't work effectively as electrodes. After the bonding agent of each metallic conductive electrode 15*c* has dried up completely, the pressurization conductive rubber 15*d* which becomes the surface of the intermediate transfer body drum 15 shall be lined into the formation of intermediate transfer body drum 15 having the structure shown in FIG. 3.

Figure 7A:
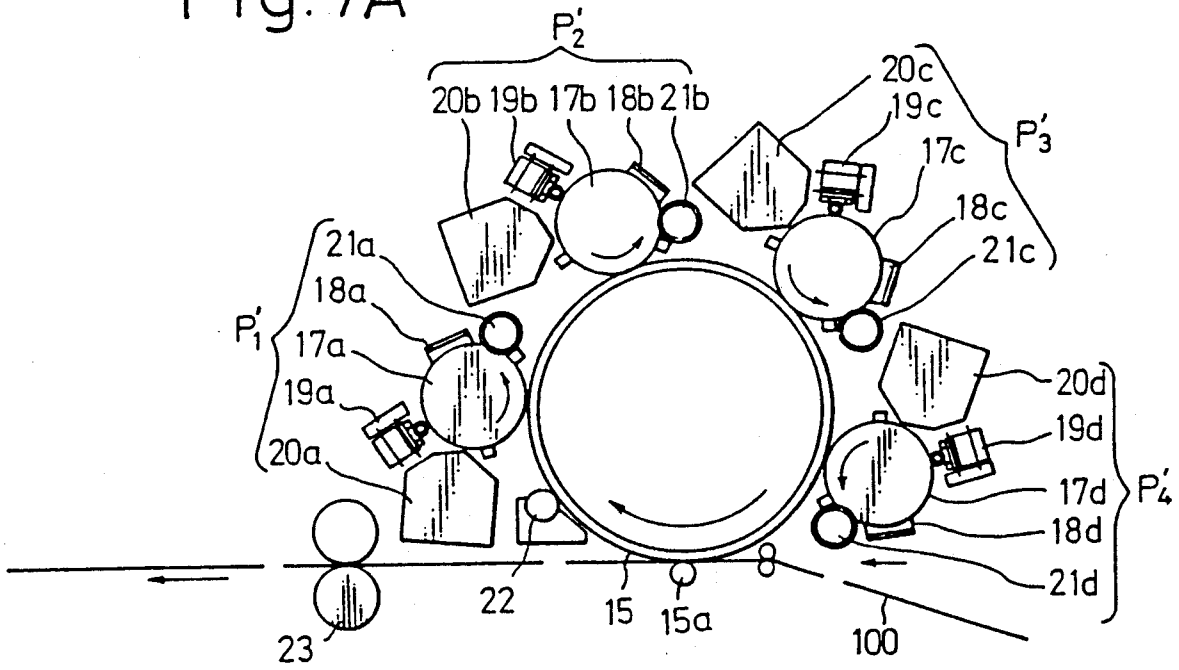
FIG. 7A is a schematic view of a color picture image formation unit to be used for the intermediate transfer body drum in accordance with the present invention.

FIG. 7A shows the structure of the color picture image formation device which comprises intermediate transfer body drum 15 which has been fabricated as described above and a plurality of photosensitive body drums. This color picture image formation device is equipped with process units or controllers P1', P2', P3' and P4' with four respective photosensitive body drums 17*a*, 17*b*, 17*c* and 7*d* positioned as their enters respectively and a fixing unit 23. The process unit P1' includes a charge device 18*a*, an exposure optical system 19*a*, a developing device 20*a* and a cleaner 21*a* positioned around the circumference of photosensitive body drum 17*a*. The other process units have the similar structure, wherein numerals 18*b*, 18*c* and 18*d* denote the charge devices, 19*b*, 19*c* and 19*d* indicate the exposure optical systems, 20*b*, 20*c* and 21*d* identify the developing devices, and 21*b*, 21*c* and 21*d* designate the cleaners. Numeral 15*a* designates a transfer roller. The developing agents of different colors are contained respectively in the developing devices 20*a* through 20*d* of individual process units. The three original colors Y (yellow), M (magenta) and C (cyan) necessary for the color recording are used in the developing devices 20*a*, 20*b* and 20*c*, while the BK for black compensation is used in the developing device 20*d*.

The recording by this device is carried out by the procedures as follows.

In recording the image, when the recording paper 100 is unrolled onto the carrier road by unit 12, the latent images corresponding to the signals of respective colors are simultaneously formed sequentially on each of photosensitive body drums 17*a* through 17*d*. The latent images are formed by uniformly charging the surfaces of photosensitive body drums 17*a* through 17*d* by use of the corresponding charge devices 18*a* through 18*d* and by exposing the images thereon by use of the exposure optical systems 19*a* through 19*d*. These latent images are developed by the developing devices 20*a* through 20*d* into the formation of the toner images of Y, M, C and BK (blocks) colors. The toner picture images on the photosensitive body drums 17*a* through 17*d* are transferred and overlapped sequentially on the intermediate transfer body drum 15 with the voltage being impressed on the aluminum tube, into the formation of toner picture images. After that, the toner images are transferred on the recording paper by the roller transfer and are fixed for their printing on recording paper 100 by use of the fixing unit 23.

The intermediate transfer body drum 15 which is used for this color picture image printing device has such a structure that the surface of aluminum tube is alumite-treated, then the metallic conductive electrodes 15 (the electrode width 1.5 mm with the intervals being 1 mm and its thickness being 1 mm) both of whose ends are pasted up at equal intervals by adhesive tapes 16 as shown in FIG. 6 are pasted up by the bonding agent onto the drum circumference, and after drying-up, a pressurization conductive rubber 15*d* having the thickness of 2 mm is lined uniformly through the entire circumference on the upper face of metallic conductive electrode 15*c* excluding one of the intermediate transfer body drums 15 by 15 mm, as will be explained below.

Figure 7B:
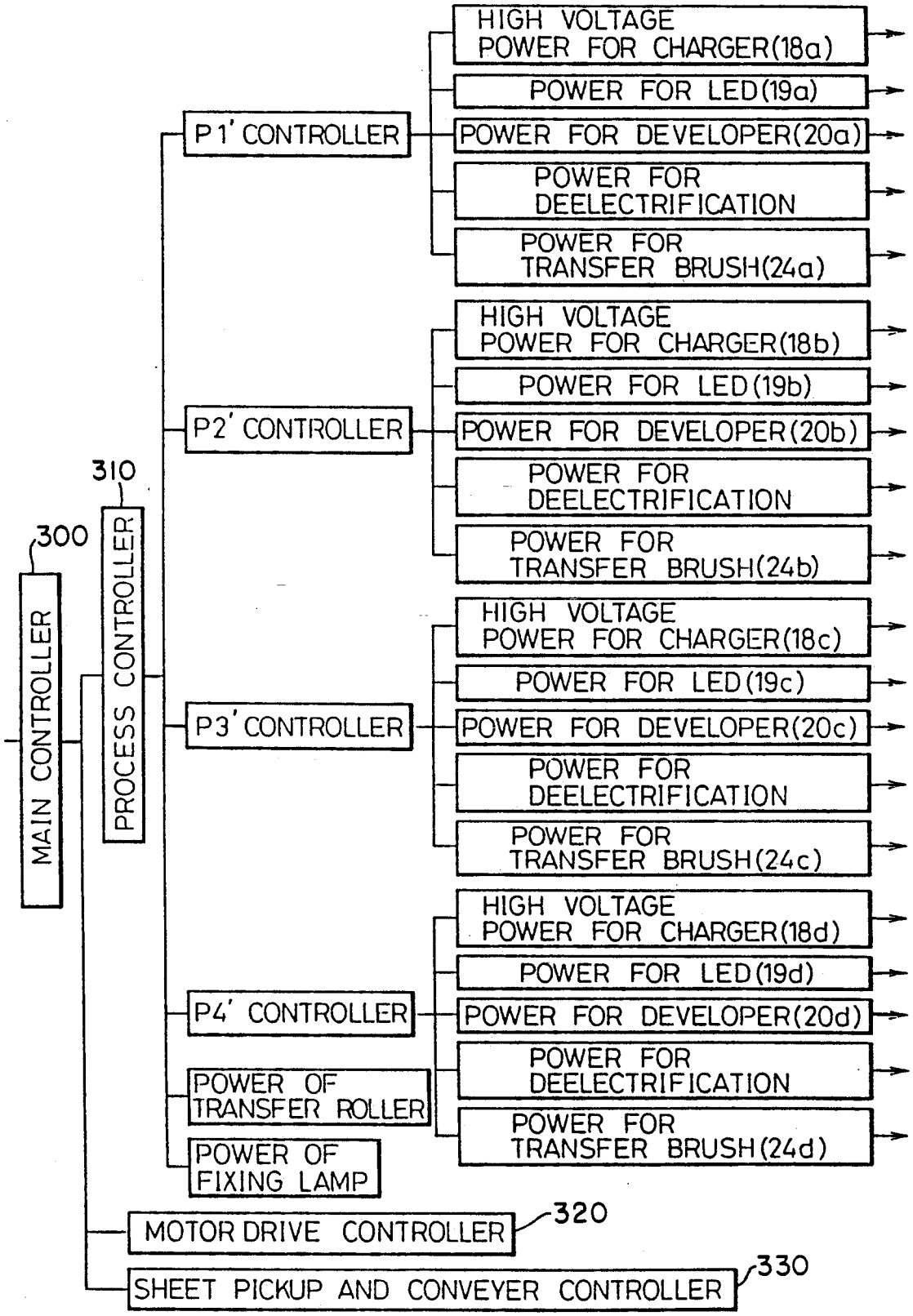
FIG. 7B is a block diagram showing a power-supply system for parts of the respective image formation sections.

FIG. 7B is a block diagram showing a power-supply system for various parts of the respective image formation sections. Each of controllers or process units P1', P2', P3' and P4' independently controls power voltages of the high voltage power for the respective charger (18*a–d*), the power for the respective exposure optical system or LED (19*a–d*), the power for the respective developing unit (20*a–d*), the power for each deelectrification unit, and the power for a transfer brush or unit (24*a–d*) which will be described in detail below. A process controller independently controls the respective controllers P1' to P4' and the power for transfer drum roller and the power for fixing lamp. A main controller 300 is provided (FIG. 7B), which is connected to controllers or process units P1', P2', P3' and P4' controls a process controller 310. A motor drive controller 320 and a sheet pick-up and sheet conveyer controller 330, as shown in FIG. 7A.

Figure 8A:
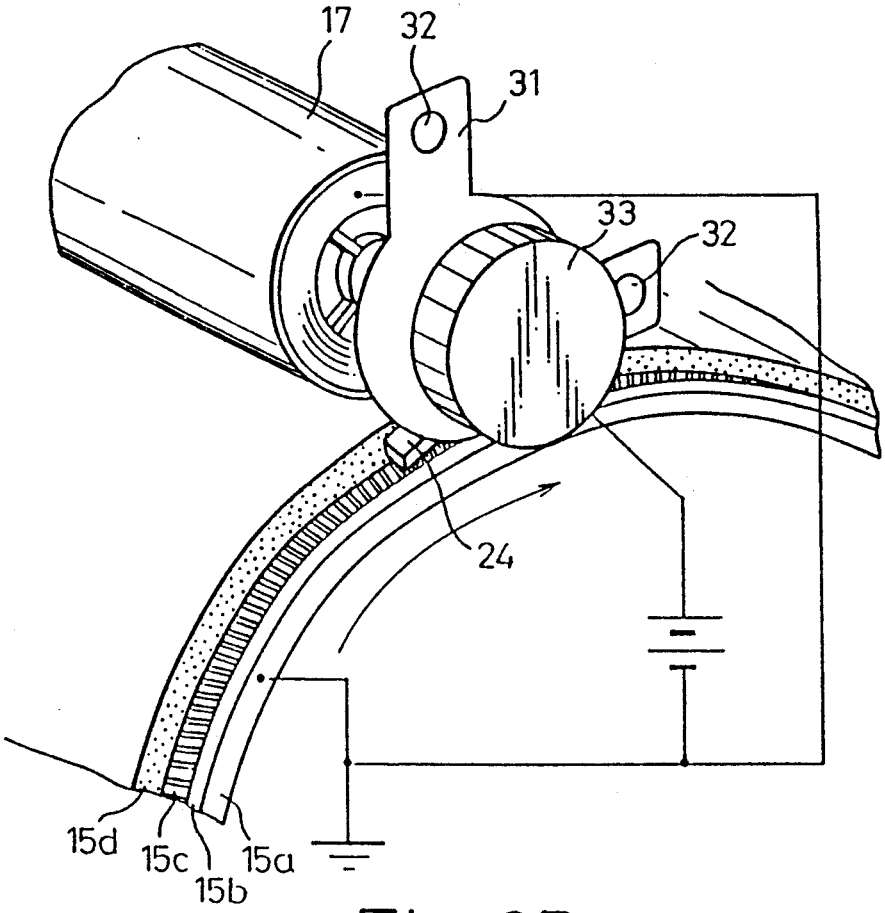
FIG. 8A is a perspective view of a primary transfer section for transferring to the intermediate transfer body drum from the photosensitive body drum.

FIG. 8A shows the area of primarily transferring, on the intermediate body 17, of the toner picture images existing on the photosensitive body drums 17*a* through 17*d* by use of the respective picture image formation sections P1', P2', P3' and P4'. This embodiment involves the case of using a negative charge toner, where a transfer voltage application conductive brush 24 is arranged to one end of intermediate transfer body drum 15, to which the pressurization conductive rubber 15*d* is not lined, at the contact section with the photosensitive body drum 17. The conductive brush 24 is located at the side of the contact section of photosensitive body drums 17*a* through 17*d* of the respective picture image formation sections P1', P2', P3' and P4', and is elongated in the transversal direction to the contact width. Additionally, a certain distance is provided between the conductive brush 24 and the photosensitive body drum 17 so that they may not come into contact with each other and an insulation film may be formed on the outside of base portion of conductive brush 24.

Figure 8B:
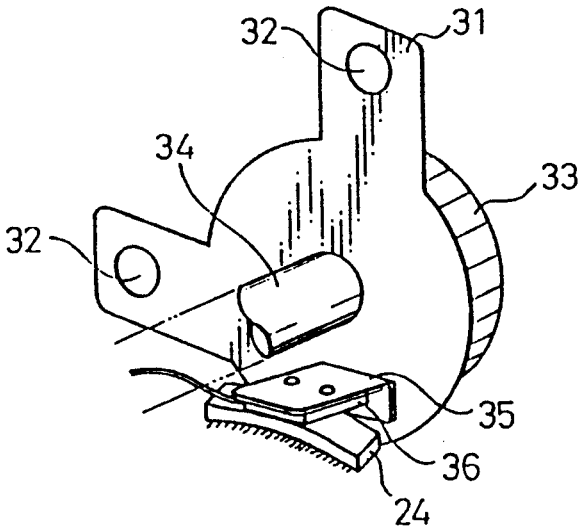
FIG. 8B is a perspective view showing a support structure for the photosensitive drum.

In FIGS. 8A and 8B, the reference numeral 31 denotes a holder for positioning the photosensitive body drum 17. The holder 31 has two guide pin holes 32 which are used for mounting the photosensitive body drum 17 on a side wall (not shown) of the printer. The conductive brush 24 is secured via an eclectically insulating plate 36 to a blacket piece 35 which is fixed to the above-mentioned holder 31 by spot-welding or the like. The conductive brush 24 is connected to the controller (FIG. 7B) by means of power supply line. A handle 33 is fixedly connected to a shaft 34 of the photosensitive body drum 17 which can be manually rotated by this handle 33.

Figure 9:
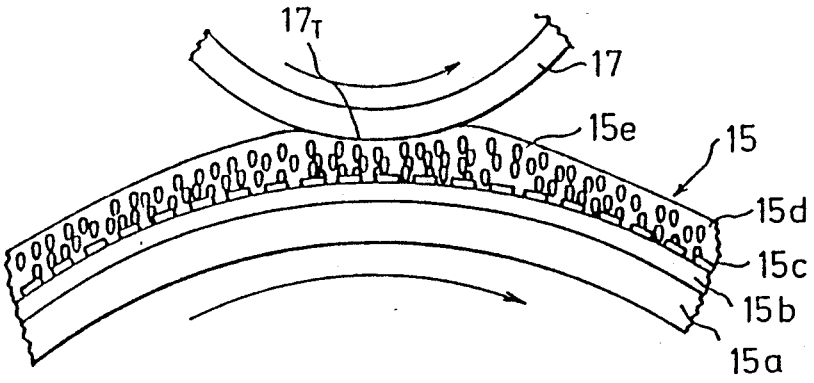
FIG. 9 is a schematic view showing the voltage situation of the primary transfer section.

FIG. 9 shows the position when the primary transfer voltage is applied to the apparatus of this invention. This is the cross section of the contact portion between the photosensitive body drum 17 and the intermediate transfer drum 15, and the transfer voltage application brush (conductive brush) is omitted in this figure. The pressurization conductive rubber 15*d* which has been lined on the intermediate transfer body drum 15 uses a silicone rubber into which the carbon 15*e* has been dispersed to provide the conductivity to the interior. The pressurization conductive rubber has a volumetric resistivity from $10^6$ to $10^{10}\Omega\cdot$cm or may preferably be in the order of $10^6\Omega\cdot$cm during its pressurization so that there may exist no short circuitry with the transfer roller and of higher than $10^{13}\Omega\cdot$cm during no pressure application. The pressurization conductive rubber 15*d* is conductive at the contact section of photosensitive body drum 17 due to the contact pressure, and the transfer voltage from the transfer voltage application brush 24 (not shown in the figure)is impressed only to the contact section through the metallic conductive electrode 15*c* and transfers the toner on the photosensitive body drum 17 onto the intermediate transfer body drum 15. In this embodiment, if the length of transfer voltage application brush 24 (not shown in the figure) should be equal to or smaller than the contact section of the photosensitive body drum 17, a part (especially the surface area on a toner layer) of the toner picture image transferred onto the intermediate transfer body drum 17 is destined to return to the photosensitive body drum 17, thus causing failure in transfer.

Figure 10:
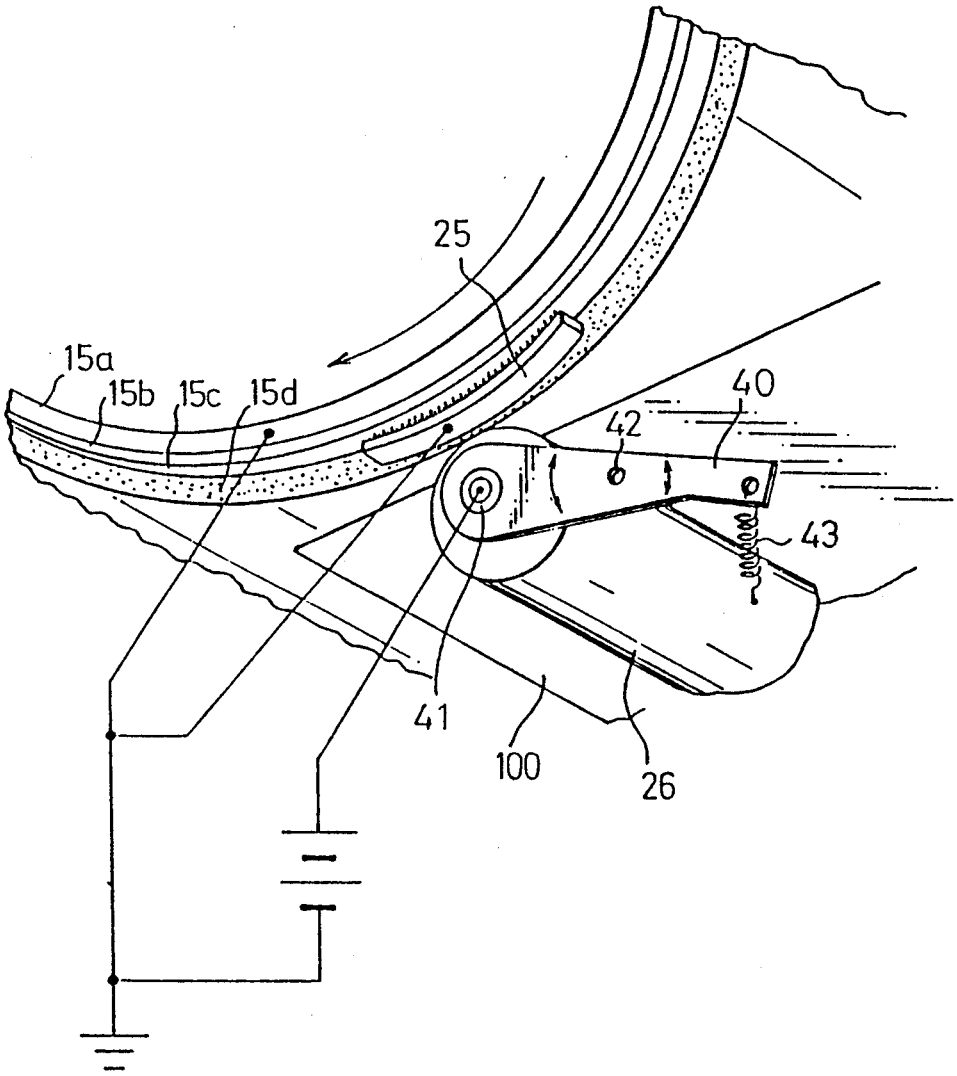
FIG. 10 is a perspective view of the secondary transfer section for transferring to the recording paper from the intermediate transfer body drum.

FIG. 10 shows the structure of a secondary transfer unit in the embodiment of the present invention. This embodiment uses a roller transfer device whole other elements are identical to the primary transfer section, wherein a conductive brush 25 is installed at the side of the contact section between a transfer roller 26 and the intermediate transfer body drum 15, and the conductive brush 25 is grounded when the recording paper 100 passes between the transfer roller 26 and the intermediate transfer body drum 15. Thereby, the electric charge for retaining the toner picture image on the intermediate transfer body drum 15 is applied along the metallic conductive electrode 15*c* from the surface of intermediate transfer body drum 15, contrary to the case of the primary transfer, and is destined to discharge to the ground from the conductive brush 25. Thereby, the transfer voltage required for the secondary transfer unit can be lowered.

Figure 11:
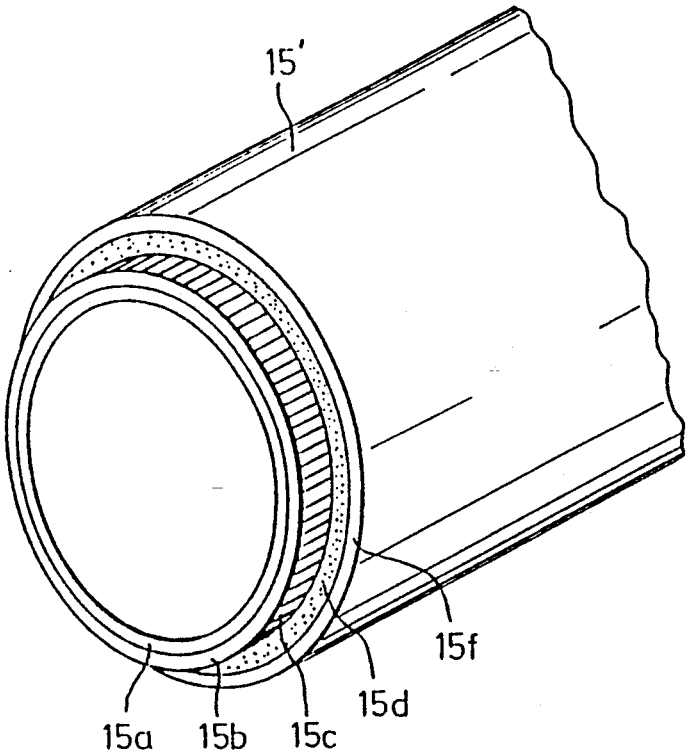
FIG. 11 is a partial perspective view of the intermediate transfer body drum of a second embodiment.

FIG. 11 shows a second embodiment of the intermediate transfer body drum. In this embodiment an intermediate transfer body drum 15' has a surface coated with a dielectric film 15. The dielectric film 15*f* is of polyethylene terephthalate (PET) which has been coated to the thickness of about 100 μm for the formation of intermediate transfer body drum. When this intermediate transfer body drum 15' was assembled into the color picture image formation device shown in FIG. 7 for the enforcement of printing, a favorable printing could be obtained similarly to the first embodiment. The surface smoothness could be improved by providing the PET film 15*f* on the surface of the intermediate transfer body drum 15', and the cleaning characteristics of the toner remaining on the intermediate transfer body drum 1 could also be enhanced in both, the blade cleaner (not shown in the figure) and the brush cleaner (not shown in the figure) that were used for the cleaning.

Figure 12:
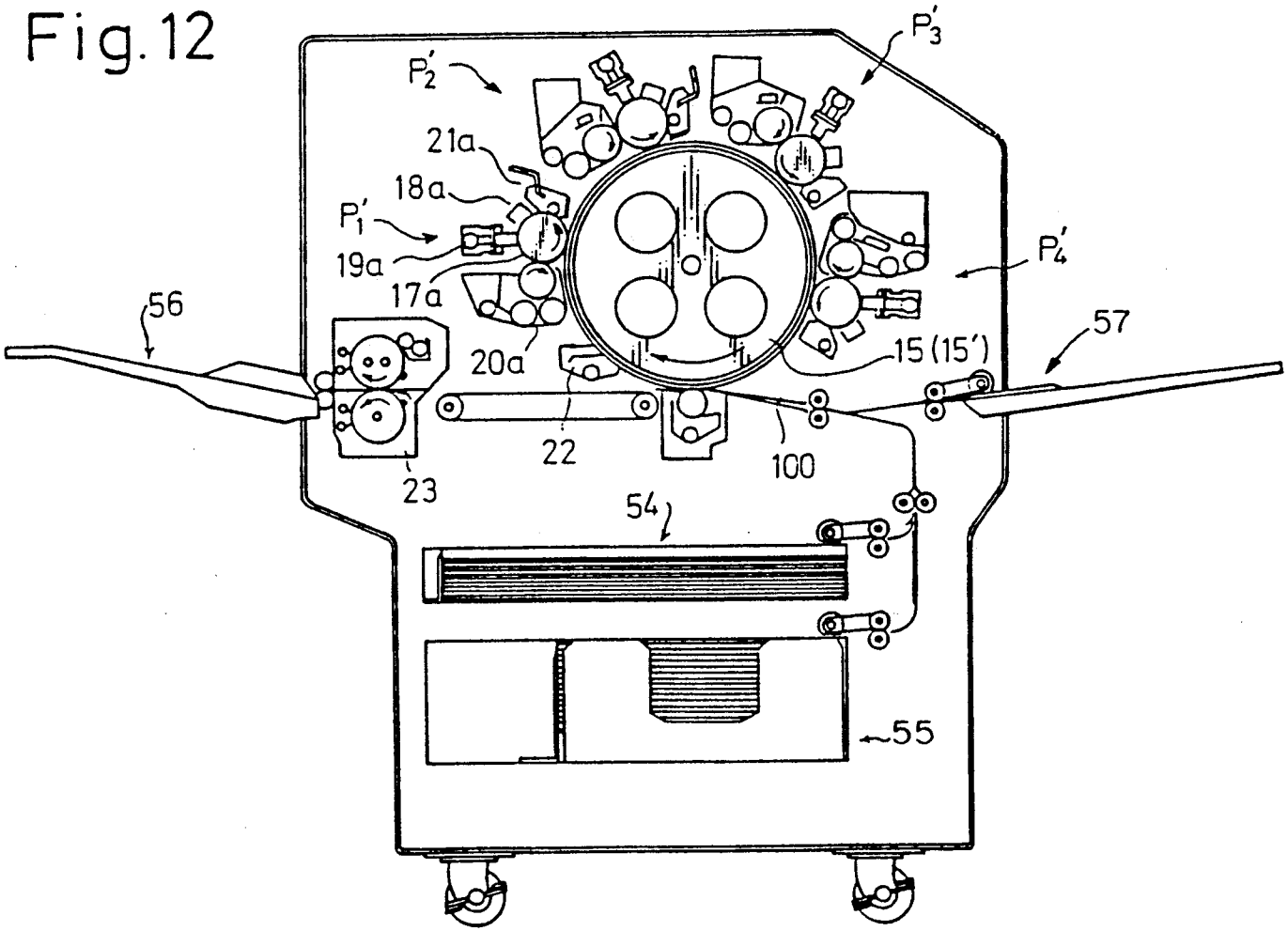
FIG. 12 is a schematic view of another color picture image formation device using the intermediate transfer body drum of this invention.

FIG. 12 shows the color picture image formation device to which the intermediate transfer bodies 15 and 15' in the first or second embodiments or 2 can be applied. Similarly to the color picture image formation device shown in FIGS. 7A and 7B, this device is equipped having process units P1', P2', P3' and P4' with 4 respective photosensitive body drums 17*a*, 17*b*, 17*c* and 17*d* at their centers, an intermediate transfer body drum 15, a fixing unit 23, recording paper hoppers 54 and 55, a recording paper outlet 56 and a recording paper delivery section 57. The process unit P1' includes a charge device 18*a*, an exposure optical system 19*a*, a developing device 20*a* and a cleaner 21*a* which are arranged around the photosensitive body drum 17*a*. The other process units have similar structures. The developing agents of different colors are contained in the developing devices of the respective process units. The three original colors Y, M and C necessary for the color recording are used respectively in the developing devices the process units P1', P2' and P3', and BK for black compensation is used in the developing device 20*d* of process unit P4'.

To clear from the foregoing description, in the intermediate transfer body drum according to the present invention, the primary transfer voltage can apply a more optimal transfer voltage depending on the conditions of each picture image formation process in the primary transfer with the photosensitive body drum 17 of each picture image formation process by arranging the thin electrodes, or metallic conductive electrodes 15*c* having the length equal to the width of the intermediate transfer body drum 15 and provided at equal intervals on the insulation layer 15*b*, pressurization conductive rubber layer 15*d*. The transfer voltage can be lowered by grounding the conductive brush 25 being in contact with the above described electrode in the secondary transfer to the recording paper of the first embodiment, unlike the case of the primary transfer. Additionally, the surface smoothness of the intermediate transfer body drum 15 could be improved and the cleaning effect could be enhanced by coating the surface of pressurization conductive rubber 15*d* of the intermediate transfer body drum 15 with the dielectric substance film 15*f*.

Figure 13:
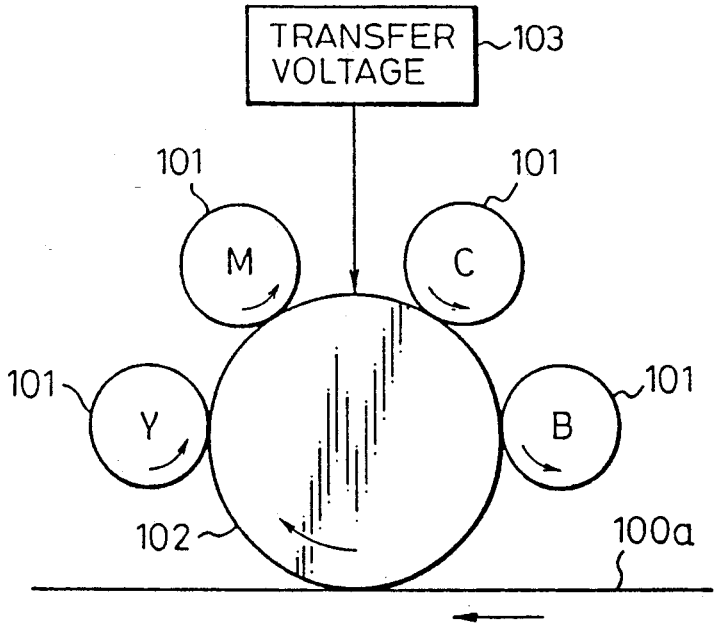
FIG. 13 is a schematic view illustrating a principle of another embodiment.
Figure 14:
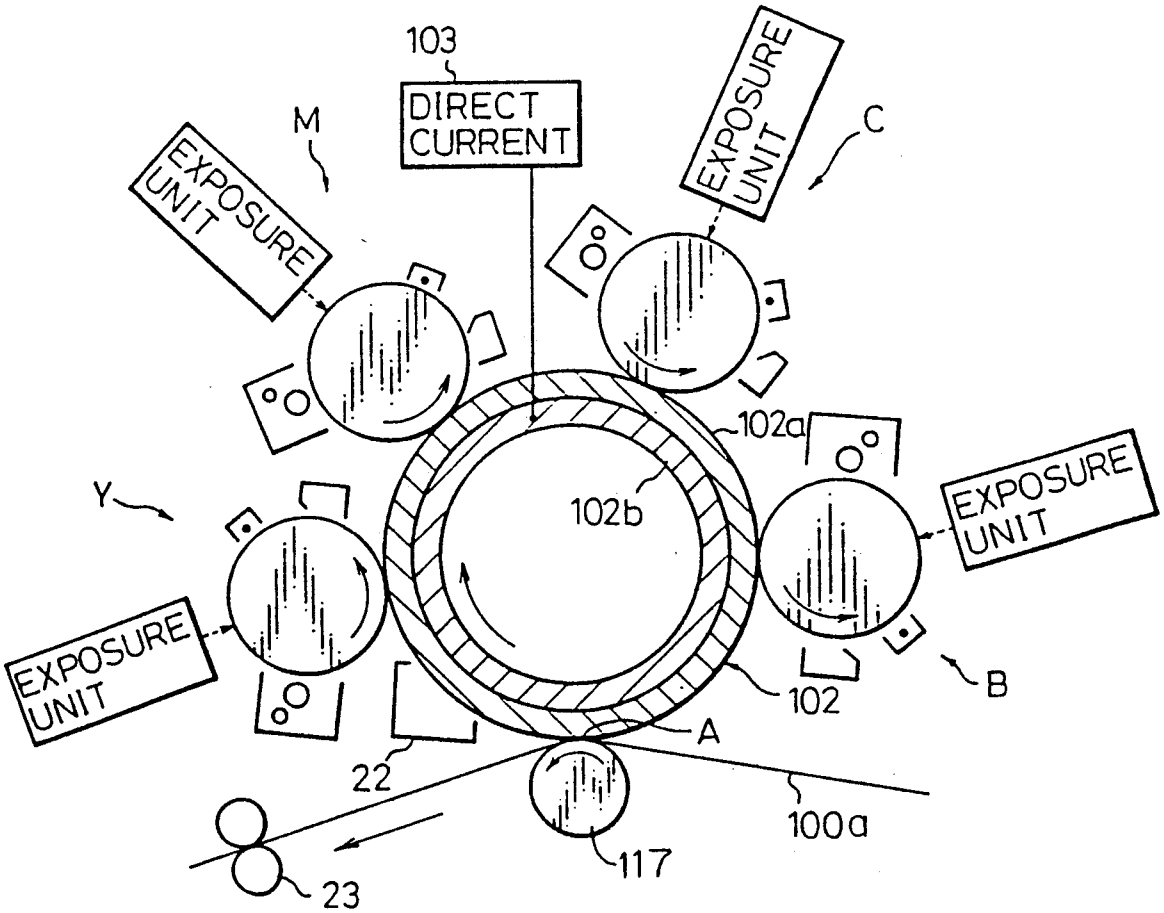
FIG. 14 is a detailed schematic view of a color printer of the embodiment shown in FIG. 13.
Figure 15:
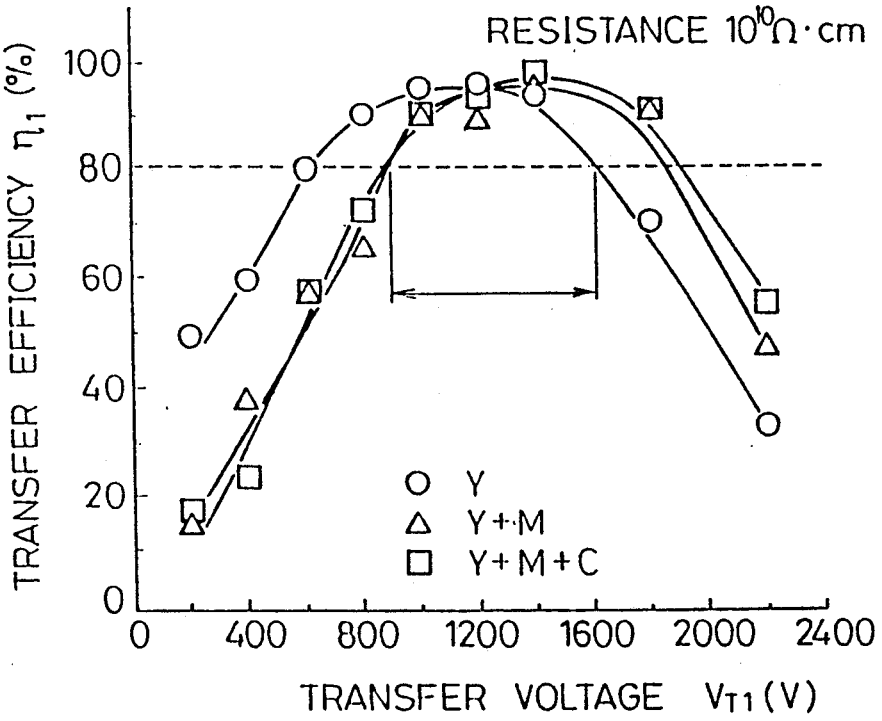
FIGS. 15 and 16 are graphs illustrating the relationship between the transfer voltage and the transfer efficiency.
Figure 16:
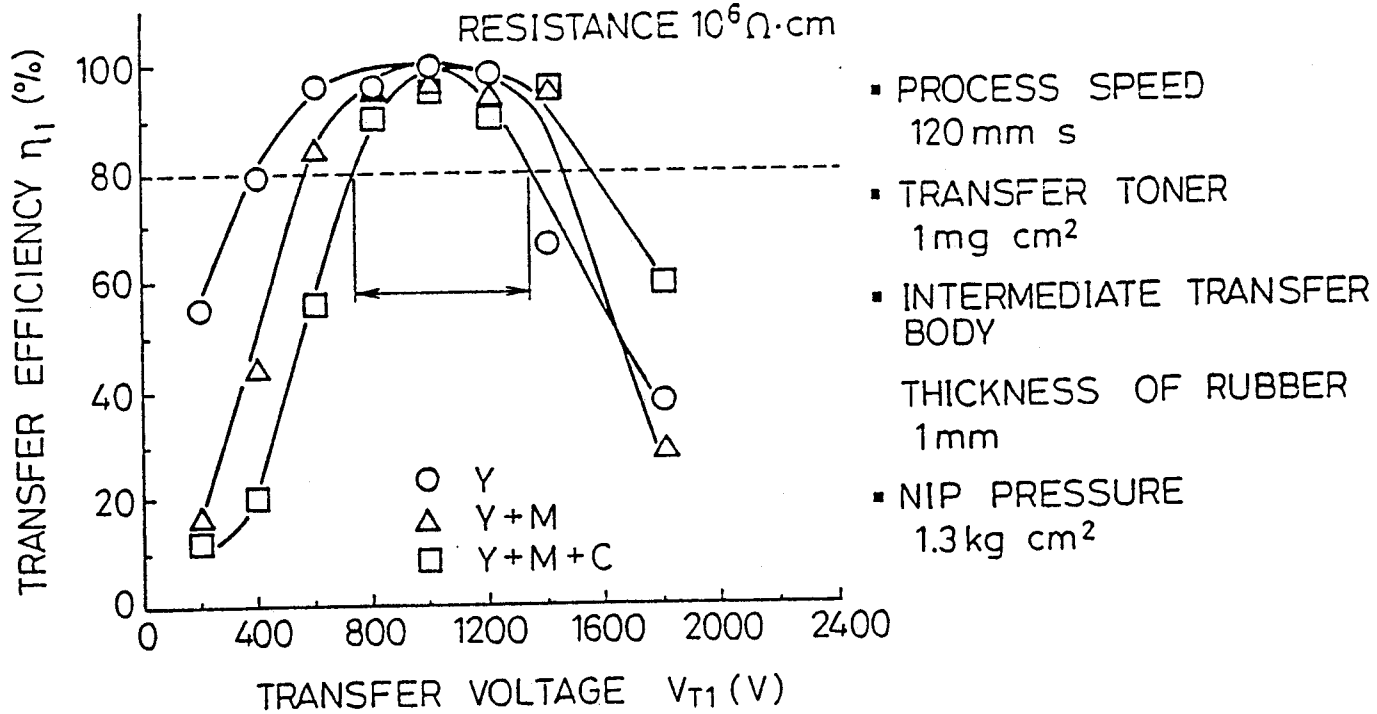

FIGS. 13 and 14 show another embodiment of this invention, in which FIG. 13 is a schematic view illustrating a principle of the embodiment, FIG. 14 shows a color printer of this embodiment. FIGS. 15 and 16 are diagrams illustrating the relationship between the transfer voltage and the transfer efficient of the embodiments of FIGS. 13 and 14.

An intermediate transfer drum 102 comprises an aluminum tube 102*b* coated with a lining material 102*a* (FIG. 14) of, for example, a resilient, electrically conductive rubber having a volume resistivity of $10^{10}\Omega\cdot$cm and a thickness of 1 mm. A transfer voltage which is a direct current power source 103 (a primary voltage), such as 800 to 1000 Volt, is exerted to the intermediate transfer drum 102 which is rotated by a drive motor (not shown) in the opposite direction as the photosensitive drum 101. Therefore, a color toner image is transferred from the photosensitive drum 101 to the intermediate transfer drum 102 (primary transfer) through the contact surface between the photosensitive drum 101 and the intermediate transfer drum 102. It is advantageous that the volume resistivity of the intermediate transfer drum 102 is $10^8$ to $10^{12}\Omega\cdot$cm.

A printing sheet 100*a* is moved between the intermediate transfer drum 102 and a transfer roller 117 and then a full color toner image is transferred from the intermediate transfer drum 102 to the printing sheet 100*a* (secondary transfer) through the contact surface between the intermediate transfer drum 102 and the printing sheet 100*a*. The full color toner image is then fixed by the fixing unit 116 onto the printing sheet 100*a*. It is advantageous that the voltage of the secondary transfer is 2000 Volt.

In the above embodiment, the following experiments have been conducted. First, the voltage of the primary transfer was changed with the range of 200 to 2200 Volt and a transfer efficiency was measured. Here, "transfer efficiency" is defined as a ratio of the amount (mg/cm$^2$)of the toner of the toner image formed on the intermediate transfer drum 102 with respect to the amount (mg/cm$^2$) of toner of the toner image on the photosensitive drum 101, i.e., the amount (mg/cm$^2$) of the transferred toner/the amount (mg/cm$^2$) of the developed toner.

As shown in FIG. 15, the transfer efficiency of a first color transferred directly on the intermediate transfer drum 102 as a lowermost layer was more than those of a second and a third colors, in the range of lower than 1200 Volt. Therefore, the primary transfer was conducted within the range of 1500 to 2400 Volt.

In the secondary transfer, the transfer efficiencies of the second and the third colors were substantially 100% and, therefore, the transfer efficiency of the secondary transfer of the first color was changed only on the basis of the transfer efficiency of the first color. Thus, transfer efficiency of the first color was 70 to 90% within the voltage range as mentioned above.

Thus the transfer efficiencies of the toners finally transferred onto the printing sheet 100 were as follows. When the primary transfer voltage was 100 Volt, the transfer efficiencies of the first color was 93%, that of the second and third was 86%. Also, when the primary transfer voltage was 2400 Volt, the transfer efficiencies of the first color was 84%, that of the second and third was 86%, since the transfer efficiencies of the first color was 90%, that of the second and third was 100%.

As mentioned above, it is advantageous that the range of voltage of the primary transfer at the intermediate transfer drum 102 is lower than 1200 Volt (in practical, ore than 600 Volt), preferably within 800 to 1000 Volt. It was confirmed that a desired color toner image was thus obtained on the printing sheet 100 at the fixing process after the secondary transfer.

We claim:

1. A color image forming apparatus comprising:

a plurality of image formation sections, each of which includes an endless image bearing member, an image forming device for forming an electrostatic image onto the image bearing member, and a developing unit for developing the electrostatic image by a color toner, and the color toner of each developing unit being different from each other;

an intermediate transfer body for holding toner images in a required number of colors and cooperating with the image bearing members so that respective color toner images on the image bearing members are transferred, and said intermediate transfer body including an endless metallic layer, an insulation layer provided onto the metallic layer, and a conductive electrode which is split thinly into sections in the direction of a longitudinal axis of said intermediate transfer body;

means for transferring the color toner image on said intermediate transfer body to a recording medium after all of the toner images have been formed on said intermediate transfer body;

means for fixing transferred toner picture images on said intermediate body to the recording medium; and voltage application brushes, provided for each image formation section, each of said voltage application brushes being constructed to come in contact with the sections of the conductive electrode at portions where the image bearing members are in contact with said intermediate transfer body.

2. A color picture image formation device comprising:

a plurality of photosensitive body drums;

a plurality of image formation sections, each comprising one of said photosensitive body drums, an electrocharge unit, an exposure unit, and a developing unit for developing a respective color toner image on a respective photosensitive body drum;

an intermediate transfer body for holding toner powder images in a required number of colors and cooperating with said photosensitive body drums so that respective color toner images on said photosensitive body drums are transferred, respectively, onto said intermediate transfer body and, after all toner picture images have been formed on said intermediate transfer body, the toner picture images thereon are transferred onto a recording paper and then fixed thereto by a fixing unit; wherein a transfer voltage which is exerted to the intermediate transfer body is regulated for a respective area corresponding to a respective developing unit and said transfer voltage is grounded at a transfer area to said recording paper, said intermediate transfer body being formed as a drum and the intermediate transfer drum having a multiple layer construction including a metallic tube, an insulation layer, an electrode and a voltage application layer provided on a surface of the metallic tube, wherein said electrode is a metallic conductive electrode arranged on the insulation layer which is split thinly into sections in a longitudinal axis direction, and wherein a transfer roller is provided for transferring the toner picture images onto said recording paper and a voltage application brush is provided such that it comes in contact with the sections of the metallic conductive electrode and the width of the metallic conductive electrode is smaller than a contact width of the photosensitive body drum, the transfer roller and the intermediate transfer drum.

3. A color picture image formation device as defined in claim 2, wherein said electrode has a width which is at most equal to a depth of said intermediate transfer drum and said sections are arranged in parallel to each other at equal distances therebetween and having ends thereof being fixed in place by adhesive tapes and wherein the width of said metallic conductive electrode is within 5 mm and its thickness is smaller than 2 mm so that is smaller than 2 mm so that it is prevented from becoming bent or broken even after coming in contact with said voltage application brush.

4. A color picture image formation device as defined in claim 3, wherein the width of said metallic conductive electrode is between 500 μm and 1 mm.

5. A color picture image formation device as defined in claim 2, wherein said electrode is a plate which has elongated cavities perforated in a width direction thereof, said plate having a thickness less than 2 mm and having a length greater than the depth of said intermediate transfer drum, each cavity having a length greater than the depth of said intermediate transfer drum.

6. A color picture image formation device as defined in claim 5, wherein, ends of said plate on said insulation layer over said intermediate transfer drum are cut off after passing a part of said ends on the insulation layer over said intermediate transfer drum so that individual thin metallic conductive electrodes are formed.

7. A color picture image formation device as defined in claim 2, wherein a pressurization conductive rubber is lined on the metallic conductive electrode of the intermediate transfer drum and which has a volumetric resistivity from $10^6$ to $10^{10}\Omega\cdot$cm to prevent short circuitry with the transfer roller.

8. A color picture image formation device as defined in claim 7, wherein a surface of said pressurization conductive rubber lined on said intermediate transfer drum is covered with a dielectric substance having a thickness from 80 to 200 μm.

9. A color picture image formation device as defined in claim 8, wherein the thickness of said dielectric substance is 100 mm.

10. A color picture image formation device as defined in claim 7, wherein said volumetric resistivity is in the order of $10^6\cdot\Omega$ cm during pressurization.

11. A color picture image formation device as defined in claim 7, wherein said volumetric resistivity is in the order of $10^6\Omega\cdot$cm during pressurization of said rubber so as to prevent short circuitry with the transfer roller, and the intermediate transfer drum is free of said rubber at a portion thereof corresponding to a width of a voltage impressing conductive brush at one end of said intermediate transfer drum.

12. A color picture image formation device as defined in claim 2, wherein said brush is longer in a circumferential direction of the intermediate transfer drum than a contact portion between said transfer roller and said intermediate transfer drum, said brush being installed to a portion where said metallic conductive electrode is exposed to a surface of said intermediate transfer drum at one end of said intermediate transfer drum to ensure that the transfer roller comes in contact with said intermediate transfer drum, with said brush being grounded at all times.

13. A color picture image formation device comprising:

a plurality of photosensitive body drums;

a plurality of image formation sections, each comprising one of said photosensitive body drums, an electrocharge unit, an exposure unit, and a developing unit for developing a respective color toner image on a respective photosensitive body drum;

an intermediate transfer body for holding toner powder images in a required number of colors and cooperating with said photosensitive body drums so that respective color toner images on said photosensitive body drums are transferred, respectively, onto said intermediate transfer body and, after all toner picture images have been formed on said intermediate transfer body, the toner picture images thereon are transferred onto a recording paper and then fixed thereto by a fixing unit; wherein a transfer voltage which is exerted to the intermediate transfer body is regulated for a respective area corresponding to a respective developing unit and said transfer voltage is grounded at a transfer area to said recording paper, and wherein, for a primary transfer between the intermediate transfer body and each photosensitive body drum, a transfer voltage application conductive brush is arranged to one end of said intermediate transfer body at a contact portion between said intermediate transfer body and each of the photosensitive body drums, and said transfer voltage application conductive brush is provided at every contact portion between each photosensitive body and said intermediate transfer body and said brush having a length greater than that of the contact portion.

14. A color picture image formation device as defined in claim 13, wherein said transfer voltage application conductive brush has a base material which is prevented from coming in contact with each photosensitive body drum, said brush having an insulation treated base material surface and wherein a voltage to be impressed to said transfer voltage application brush can be adjusted in the primary transfer from each of the photosensitive body drums so that a favorable transfer may be achieved for all picture image formation sections.

15. A color picture image formation device comprising:

a plurality of image formation sections, each comprising a photosensitive means, an electrocharge unit, an exposure unit, and a developing unit for developing a single color toner image on said photosensitive means;

an intermediate transfer body for holding toner powder images in a required number of colors, said intermediate transfer body cooperating with each photosensitive means so that the respective color toner images on said photosensitive means are transferred, respectively, onto said intermediate transfer body;

means for transferring the color toner image on said intermediate transfer body to a recording medium after all of said toner picture images have been formed on said intermediate transfer body; and means for fixing the transferred toner picture images on said intermediate body to the recording medium;

means for exerting a voltage between said intermediate transfer body and each photosensitive means for transferring the respective color toner picture images; and means for applying a transfer voltage between said intermediate body and each photosensitive means such that a transfer efficiency of a first color transferred directly to said intermediate transfer body as a lowermost layer is greater than those of the colors other than the first color, wherein the transfer efficiency is defined as a ratio of an amount of a toner of the toner image formed on said intermediate transfer body to an amount of a toner of the toner image formed on the respective photosensitive means.

16. A color picture image formation device as defined in claim 15, wherein a circumferential surface of said intermediate transfer body i coated with a conductive, resilient member having a volume resistivity of $10^8$ to $10^{12}\Omega\cdot$cm and a range of a transfer voltage is 600 to 1200 Volt.

17. A color picture image formation device as defined in claim 16, wherein said range of said transfer voltage exerted by said voltage exerting means is 800 to 1000 Volt.

* * * * *